US011446202B1

(12) United States Patent
Dai et al.

(10) Patent No.: US 11,446,202 B1
(45) Date of Patent: Sep. 20, 2022

(54) PNEUMATIC PHYSIOTHERAPY APPARATUS WITH A UNIQUE STRUCTURE

(71) Applicant: JKH Health Co., Ltd., Shenzhen (CN)

(72) Inventors: Quanqin Dai, Diamond Bar, CA (US); Pu Jiang, Shenzhen (CN); Baohua Jiang, Shenzhen (CN)

(73) Assignee: JKH Health Co., Ltd., Shenzhen (CN)

( * ) Notice: Subject to any disclaimer, the term of this patent is extended or adjusted under 35 U.S.C. 154(b) by 0 days.

(21) Appl. No.: 17/564,136

(22) Filed: Dec. 28, 2021

(51) Int. Cl.
*A61H 9/00* (2006.01)

(52) U.S. Cl.
CPC ..... *A61H 9/0078* (2013.01); *A61H 2201/02* (2013.01); *A61H 2201/164* (2013.01); *A61H 2201/1619* (2013.01); *A61H 2201/1635* (2013.01); *A61H 2201/5007* (2013.01); *A61H 2201/5043* (2013.01); *A61H 2209/00* (2013.01)

(58) Field of Classification Search
CPC ..... A61H 9/00; A61H 9/005; A61H 9/0078; A61H 9/0092; A61H 9/0085; A61H 11/00; A61H 2011/005; A61H 2209/00; A61B 5/0235; A61F 2007/0091; A61F 5/012; A41D 19/0024; A41D 19/01594
See application file for complete search history.

(56) References Cited

U.S. PATENT DOCUMENTS

2010/0292622 A1* 11/2010 Weissleder ..... A61F 5/0193 602/23
2014/0303533 A1* 10/2014 Zeutzius ..... A61H 9/0092 601/151
2016/0129186 A1* 5/2016 Douglas ..... G16H 40/67 601/84
2019/0125619 A1* 5/2019 Zeutzius ..... A61H 9/0092
2019/0192375 A1* 6/2019 Sekiraqa ..... A61H 1/00
2020/0121545 A1* 4/2020 Parker, Sr. ..... A61H 9/0078
2020/0237607 A1* 7/2020 Raman ..... A61H 9/0092
2021/0015698 A1* 1/2021 Spyropoulos ..... A61H 9/0092
2021/0251842 A1* 8/2021 Raman ..... A61H 9/0078

FOREIGN PATENT DOCUMENTS

EP 2862547 A1 * 4/2015 ..... A61F 5/01

* cited by examiner

*Primary Examiner* — Bradley H Philips
*Assistant Examiner* — Savannah L Gabriel
(74) *Attorney, Agent, or Firm* — Karthik Murthy; Murthy Patent Law PLLC

(57) ABSTRACT

A pneumatic physiotherapy apparatus with a unique structure comprising a wrap and an operating unit: wherein a wrap includes at least an outer wrap, an inner component housing, and an inner air bladder set; the operating unit is fixed to the outer wrap; the operating unit is also connected to the inner component housing; and the inner component housing is hidden inside the wrap. In addition, the apparatus can also have the operating unit operate an inflation motor and an integrated control board. The apparatus uses an inner air bladder set wherein each air bladder is inflatable. The apparatus can also contain a solenoid valve and a pressure detection valve. This design hides bulky components and eliminates connecting brackets. Therefore, this apparatus is a unique structure that allows a user to experience the extraordinary beauty of pneumatic physiotherapy apparatuses.

19 Claims, 9 Drawing Sheets

PNEUMATIC PHYSIOTHERAPY APPARATUS WITH A UNIQUE STRUCTURE

TECHNICAL FIELD

The invention relates to a pneumatic physiotherapy apparatus, especially a pneumatic physiotherapy apparatus with a unique structure.

BACKGROUND

The pneumatic physiotherapy apparatus is used to repeatedly inflate and deflate one or more air bladders wrapped on the extremities and other body areas to form sequential compression, thereby promoting blood flow to prevent or treat some diseases, such as deep vein thrombosis. In order to achieve sequential compression from the distal to the proximal, the prior art usually includes a wrap and a controller that are connected with or without exposed tubes. The wrap applies a divider (also called an isolation peninsula) in the middle area of its inflatable air bladder to separate the first lower section and the second upper section, or uses more than one air bladder to form an air flow passageway from the distal to the proximal. During the period of inflation, the air flow first enters the distal, and then flows to the proximal through the air flow passageway, so that the first and second sections of the air bladder or the more than one air bladder will reach the preset pressure. However, the controller fixed or attached to the wrap is usually bulky, making it not attractive or even not convenient for use. As humans, we all are more or less attuned to the attractive beauty, and the marketing in our modern life would have us believe that the attractive beauty is about physical attributes. Therefore, further improvements are necessary.

SUMMARY

The purpose of the invention is to provide a pneumatic physiotherapy apparatus with a unique structure to overcome the problems set forth above in the prior art. A pneumatic physiotherapy apparatus with a unique structure designed for this purpose includes a wrap and an operating unit. The wrap includes at least an outer wrap, an inner component housing, and an inner air bladder set (also with the heating/cooling components included if applied); the operating unit is fixed to the outer wrap and connected to the component housing to operate the components inside the component housing; the component housing contains components of an inflation motor and an integrated control board that are electrically powered by the battery inside the component housing or by a battery bank/AC adapter outside the component housing; the inner air bladder set includes the one or more than one air bladder that is inflatable. The inflation motor that is controlled by the integrated control board inflates the inner air bladder set.

The component housing also contains a solenoid valve and a pressure detection valve; the solenoid valve, pressure detection valve, and the inflation motor are electrically connected to the integrated control board. When the inflation pressure inside the air bladder reaches a preset value, the pressure detection valve detects and sends signals to the integrated control board. After receiving signals, the integrated control board will stop the inflation motor. After the inflation motor stops, the air bladder set will immediately deflate, or maintain a preset pressure for a certain period of time prior to deflation.

A single or multiple control button is provided on the front or side of the operating unit; the control button can be a convex button, a concave button, a flat button, or a touch button. A display indication is arranged on the front or side of the operating unit; the indication can be a digital display, an LCD display screen, or a light indicator(s).

A component housing is fixedly arranged inside the wrap. The component housing contains several screw posts and/or buckle grooves, and is fixedly connected to the operating unit through the screw posts and/or buckle grooves to form an integrally fixed connection between the operating unit and the component housing.

The wrap can be used to cover different treatment areas, including leg, arm, buttock, waist, or other body areas.

Through the above-mentioned improvements, the invention is provided with a wrap and an operating unit: The wrap includes at least an outer wrap, an inner component housing, and an inner air bladder set; the operating unit is fixed to the outer wrap and connected to the component housing to operate the components inside the component housing.

In U.S. Ser. No. 10/966,729B1 the controller is fixed to the wrap through a connecting bracket, and all the components are protectively housed in the controller.

U.S. Ser. No. 10/966,729B1 "pneumatic physiotherapy apparatus with optimized compression" is hereby fully incorporated by reference.

In comparison, the present invention has an operating unit outside the wrap. Most or all of the components are protectively housed in the component housing, and the operating unit is just used by the user to control the components in the component housing.

Therefore, compared to the prior art with a bulky controller, this invention only exposes a small operating unit and hides the component housing of all the bulky components inside the wrap. Such a unique structure allows us to experience the extraordinary beauty of pneumatic physiotherapy apparatuses, and also allows us to remove the connecting bracket in U.S. Ser. No. 10/966,729B1. Furthermore, the present invention makes the exposed operating unit much smaller than the exposed controller in U.S. Ser. No. 10/966,729B1.

In general, this invention has the characteristics of simple and reasonable structure, excellent performance, convenient use, reliable comfort, and strong practicability. Therefore, users may be more willing to use the pneumatic physiotherapy apparatus of this invention to enhance their experience, improve blood circulation, relieve pain, prevent deep vein thrombosis, and treat lymphedema and other diseases.

DETAILED DESCRIPTION

Figure 1:
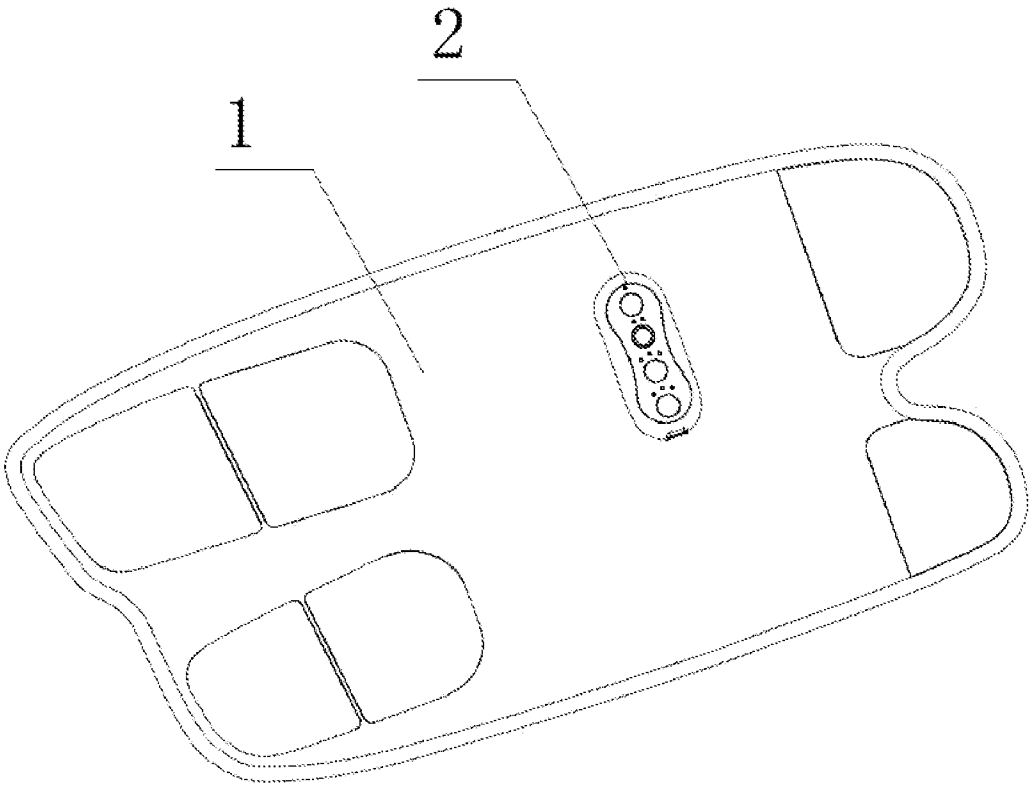
FIG. 1 is a schematic diagram of the first embodiment of the present invention.
Figure 2:
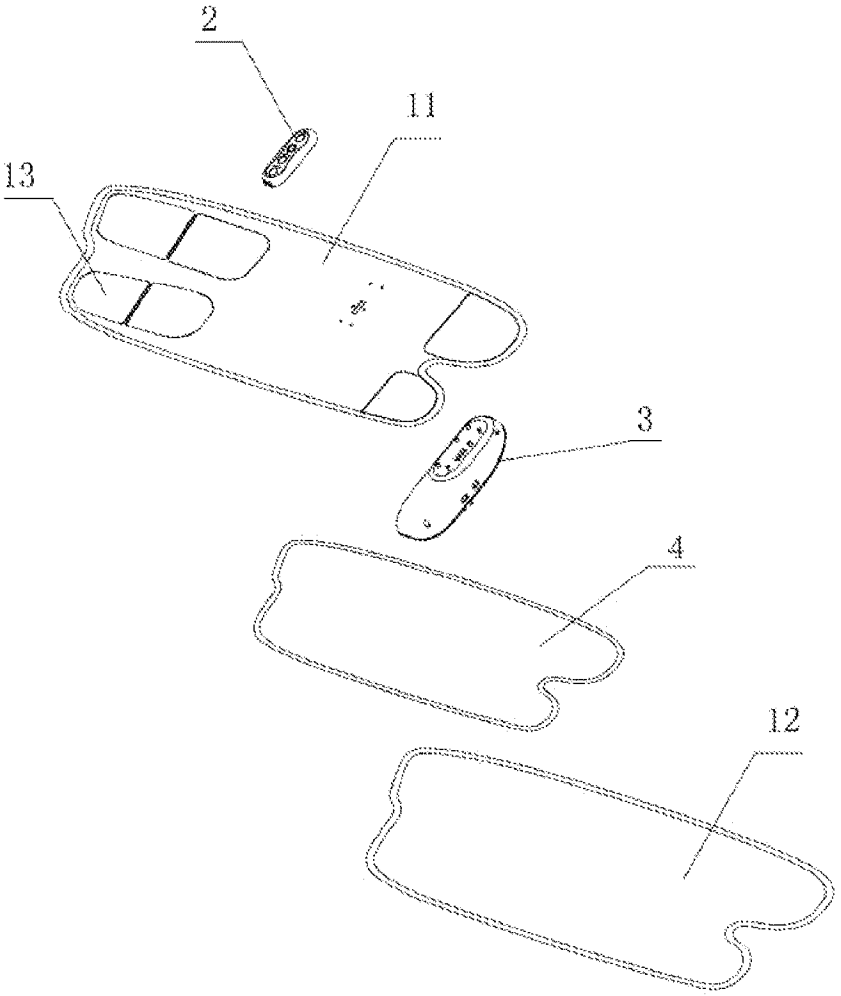
FIG. 2 is a schematic diagram of the exploded structure of the first embodiment of the present invention.
Figure 3:
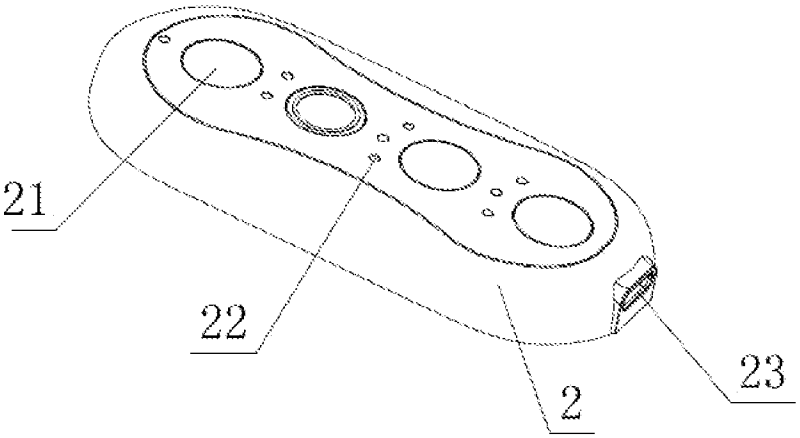
FIG. 3 is a schematic diagram of the operating unit of the first embodiment of the present invention.
Figure 4:
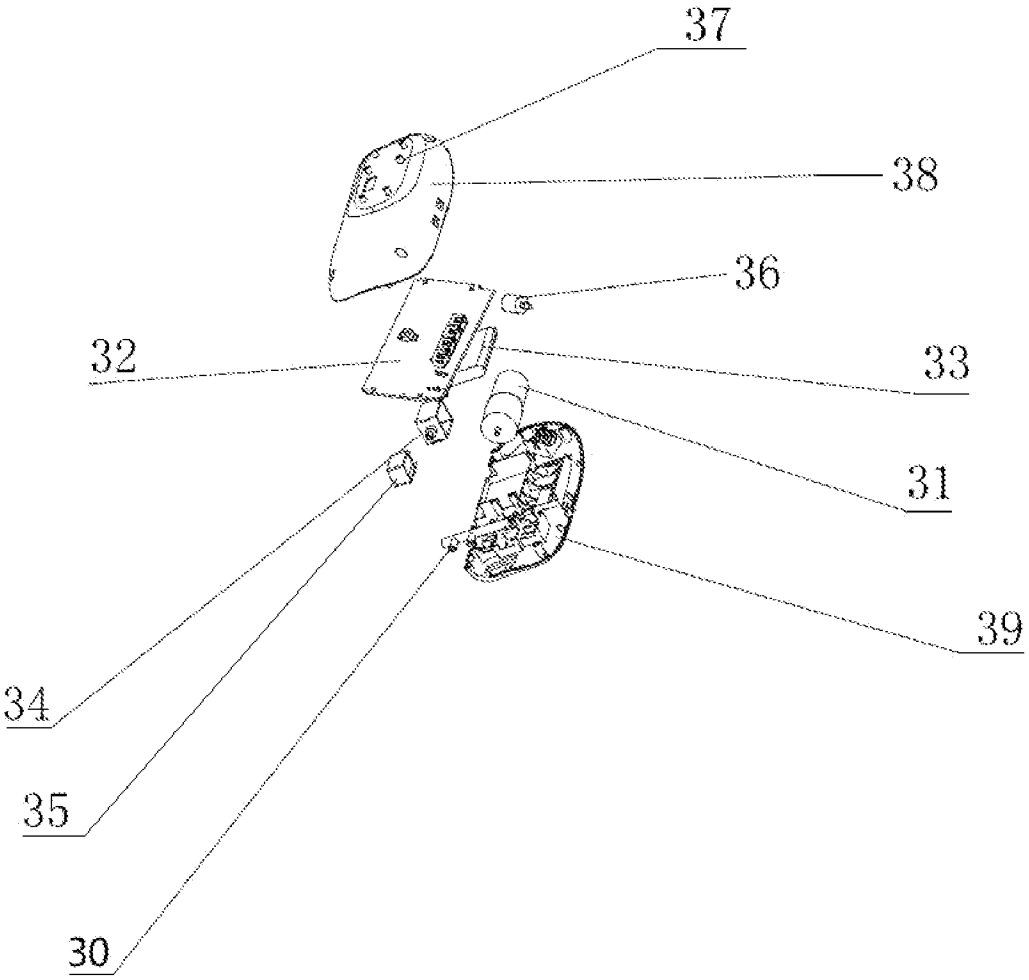
FIG. 4 is a schematic diagram of the component housing of the first embodiment of the present invention.

The present invention will be further described below with reference to the drawings and embodiments.

The First Embodiment

Referring to FIGS. 1 to 4, the pneumatic physiotherapy apparatus with a unique structure includes a wrap 1 and an operating unit 2. The wrap 1 includes at least an outer wrap (such as an upper outer wrap 11 and a lower outer wrap 12), an inner component housing 3, and an inner air bladder set 4; the operating unit 2 is fixed to the wrap 1 and connected to the inner component housing 3 to operate the components inside the inner component housing 3; the inner component housing 3 contains components of an inflation motor 31 and an integrated control board 32 that are electrically powered by the battery 33 inside the inner component housing 3 or by a battery bank/AC adapter outside the inner component housing 3; the inner air bladder set 4 includes one or more than one air bladders that are inflatable. The inflation motor 31 that is controlled by the integrated control board 32 inflates the inner air bladder set 4. There is no outer component housing.

Specifically, the inner component housing 3 is arranged inside the wrap 1. The inner component housing 3 contains most or all components needed for a pneumatic physiotherapy apparatus, and is hidden inside the wrap 1. The inner component housing 3 is hidden inside the wrap 1, such that it cannot be seen from outside the apparatus. Therefore, the exposed operating unit 2 connected to the inner component housing 3 becomes attractive.

The inner component housing hidden inside the wrap is not small. Instead, the exposed operating unit is outside the wrap and is small, compared to the inner component housing.

In order to detect and control the air pressure, the inner component housing 3 also contains a solenoid valve 34 and a pressure detection valve 35. The solenoid valve 34, pressure detection valve 35, and the inflation motor 31 are electrically connected to the integrated control board 32. When the inflation pressure inside the air bladder set 4 reaches a preset value, the pressure detection valve 35 detects and sends signals to the integrated control board 32. After receiving signals, the integrated control board 32 will stop the inflation motor 31. After the inflation motor 31 stops, the air bladder set 4 will immediately deflate, or maintain a preset pressure for a certain period of time prior to deflation.

In order to avoid the safety concern caused from the excessive pressure in the air bladder set 4, a pressure protection valve 36 can be equipped in the inner component housing 3. When the pressure inside the air bladder set 4 is excessive and beyond an allowable pressure range, the pressure protection valve 36 will be activated, and the excessive pressure will release from the air bladder set 4.

The excessive pressure level varies. For example, if the maximum preset pressure is 50 mmHg, any pressure higher than 50 mmHg and its tolerance will be excessive. If the maximum preset pressure is 120 mmHg, any pressure higher than 120 mmHg and its tolerance will be excessive.

In addition, the inner component housing 3 also contains several screw posts and/or buckle grooves 37. The inner component housing 3 is fixedly connected to the operating unit 2 through the screw posts and/or buckle grooves 37 to form an integrally fixed connection between the operating unit 2 and the inner component housing 3. The inner component housing 3 also includes a first housing 38 and a second housing 39; the first housing 38 and the second housing 39 are fixedly connected to each other, and form a cavity. The cavity is used to load the components including the inflation motor 31, the integrated control board 32, the battery 33, the solenoid valve 34, the pressure detection valve 35, and the pressure protection valve 36. One or more than one connection tubing 30 and wiring may be needed to make connection between the above components.

For ease of use, a single or multiple control button 21 is provided on the front or side of the operating unit 2; the control button 21 can be a convex button(s), a concave button(s), a flat button(s), or a touch button(s). The user can use the control button 21 on the operating unit 2 to operate the pneumatic physiotherapy apparatus with a unique structure of this invention. A display indication 22 is arranged on the front or side of the operating unit 2; the display indication 22 can be a digital display, an LCD display screen, or a light indicator(s). The user can observe the working state of the operating unit 2 through the display indication 22 when in use. In addition, a charging port 23 is provided on the front or side of the operating unit 2, and used to charge the battery 33 in the component housing 3.

The wrap 1 can be used to cover different treatment areas, including calf, foot, leg, arm, buttock, waist, or other body areas. The wrap 1 in this first embodiment is for the body area of calf, and is used as an example for description. In use, a user wears the wrap 1 on the calf via the Velcro 13, and simply operates the operating unit 2 to achieve a preset pressure compression for compression treatment. This invention of a pneumatic physiotherapy apparatus has the characteristics of simple and reasonable structure, excellent performance, convenient use, reliable comfort, and strong practicability. Therefore, the user can use this invention to enhance use experience, improve blood circulation, relieve pain, prevent deep vein thrombosis, and treat lymphedema and other diseases.

The invention improves blood flow or circulation, and relieves pain, because the invention is a type of powered inflatable tube device, which "is a powered device intended for medical purposes, such as to relieve minor muscle aches and pains and to increase circulation. It simulates kneading and stroking of tissues with the hands by use of an inflatable pressure cuff."

www.accessdata.fda.gov/scripts/cdrh/cfdocs/cfcr/cfrsearch.cfm?fr=890.5650

Lymphedema has no known cure in modern medicine, and one potential symptom of lymphedema is that "[t]ime of venous outflow period of blood flow puke was lower in lymphedema-affected arms than in healthy normal or lymphedema nonaffected arms." From the journal "Lymphatic research and biology", article "Segmental Blood Flow and Hemodynamic State of Lymphedematous and Nonlymphedematous Arms", section "Methods and Results", March 2011. www.ncbi.nlm.nih.gov/pmc/articles/PMC3060729/

Therefore, by utilizing the present invention, a user could increase blood flow to their arms, and thus counteract the lymphedema-caused low blood flow. Regular blood flow may ease the pain that a user feels in his/her arms, and may help the user perform regular activities in a better manner than with low blood flow.

"Accesses that show a large (>15%) decrement in vascular access blood flow are associated with a high risk of thrombosis. Serial measurements of vascular access blood flow predict access thrombosis." From the journal "Kidney International", article "Change in access blood flow over time predicts vascular access thrombosis", November 1998.

www.sciencedirect.com/science/article/pii/S0085253815308036

Therefore, a user who utilizes the present invention can improve their blood flow, and help to prevent thrombosis.

In order for the user to view the usage data of the pneumatic physiotherapy apparatus with a unique structure, the front or side of the operating unit 2 is optionally provided with a USB interface. The operating unit 2 can connect to the data cable and the computer through the USB interface to read the usage data. In an alternative embodiment, a memory card can be optionally provided on the front or side of the operating unit 2. When the memory card is plugged into the front or side of the operating unit 2, the memory card can record the usage data of the pneumatic physiotherapy apparatus with a unique structure. In another alternative embodiment, the operating unit 2 or the component housing 3 is optionally equipped with a Bluetooth module, and the user can wirelessly connect a smart device (such as a smart phone) to the Bluetooth module to read the usage data of the pneumatic physiotherapy apparatus with a unique structure.

Optionally, the usage data can then be analyzed through artificial intelligence in order to determine optimal patterns for using the pneumatic physiotherapy apparatus with a unique structure. For example, perhaps a user prefers using the apparatus in a certain rhythm, then the artificial intelligence can learn that rhythm and utilize it again in case the person forgets, or perhaps use the rhythm on a different person in order to determine whether the new person enjoys the same rhythm as the original person. Instead of a rhythm, the artificial intelligence might also learn a certain series of buttons that the user likes being pushed, and this pattern could be remembered and shared by the artificial intelligence. Another possibility is that the artificial intelligence could analyze the usage data and could determine certain body parts that a person likes to use the apparatus on. Another possibility is that the artificial intelligence could analyze the usage data and could determine the optimal amount of time that a user wants the apparatus on particular body parts. It's also possible that the usage data could be analyzed by experts in the field, and they could provide recommendations.

Some optional alternatives to artificial intelligence are machine learning, deep learning, and neural networks, each of which could fulfill the same functions as listed above.

The Second Embodiment

In this second embodiment, the wrap 1 also includes an extra heating layer 5, in addition to the outer wrap (such as an upper outer wrap 11 and a lower outer wrap 12), the inner component housing 3, and the inner air bladder set 4.

Figure 5:
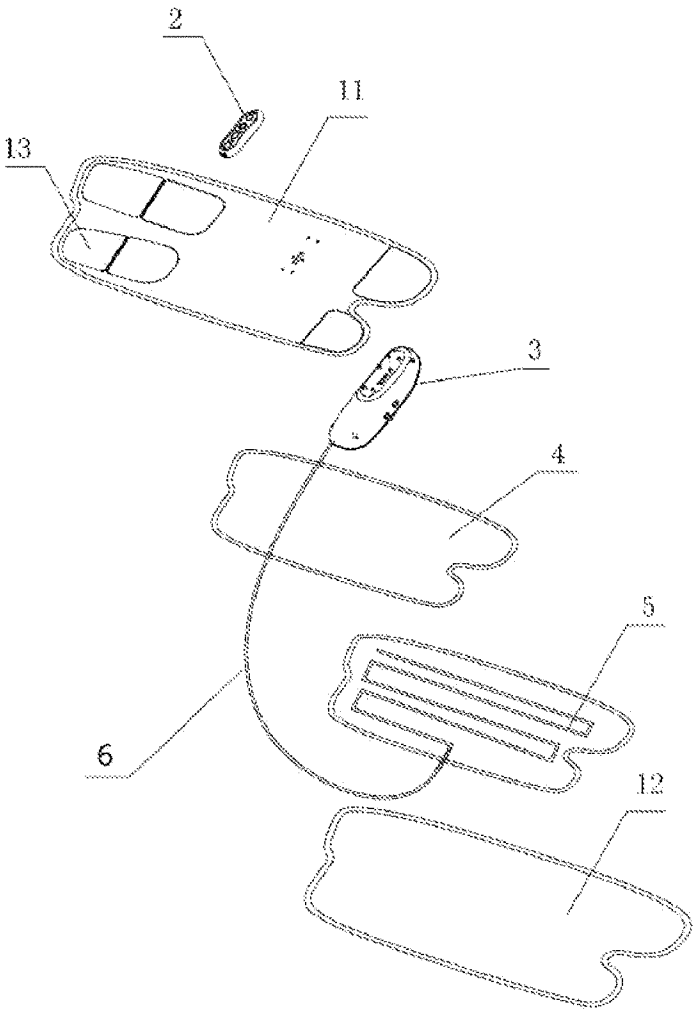
FIG. 5 is a schematic diagram of the exploded structure of the second embodiment of the present invention.

Referring to FIG. 5, the difference between this second embodiment and the first embodiment is that the wrap 1 includes an extra heating layer 5 in this second embodiment. Therefore, this second embodiment can also provide a heating treatment in addition to the compression treatment.

Specifically, the extra heating layer 5 is electrically connected to the component housing 3 via a conductive wire or another conductive connection 6. And the operating unit 2 will have the respective control button 21 to control the heating treatment. The conductive wire or another conductive connection 6 may be made of copper.

Other undescribed parts in this second embodiment are the same as in the first embodiment.

The Third Embodiment

In this third embodiment, an external patch 7 is attached to and detached from the wrap 1, and the external patch 7 is used to provide hot/warm and/or cold/cool treatment.

Figure 6:
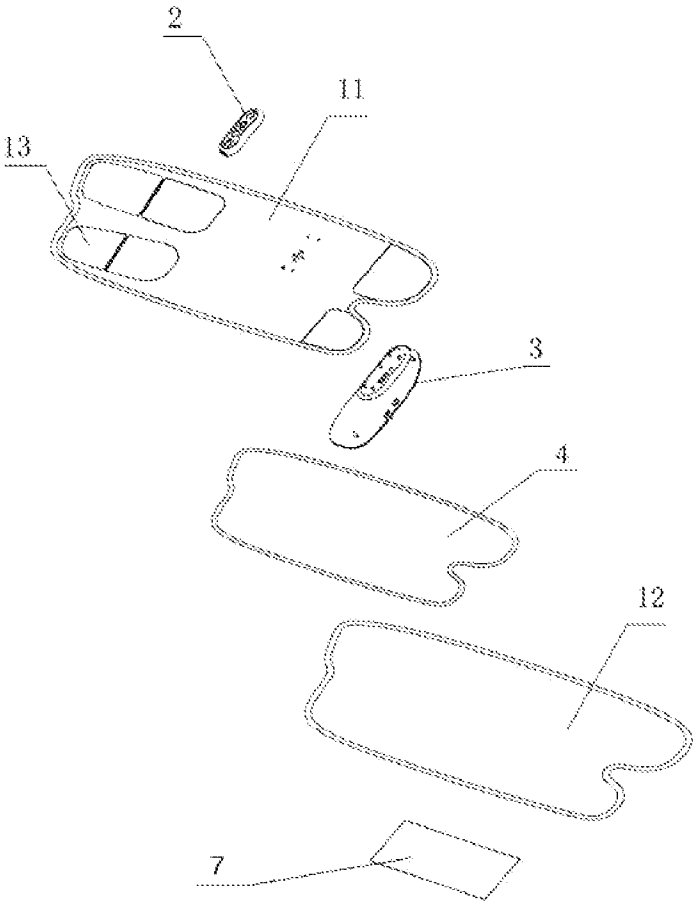
FIG. 6 is a schematic diagram of the exploded structure of the third embodiment of the present invention.

Referring to FIG. 6, the difference between this third embodiment and the first embodiment is that an external patch 7 is attached to and detached from the wrap 1 in this third embodiment. Therefore, this third embodiment can also provide the hot/warm and/or cold/cool treatment in addition to the compression treatment.

The external patch 7 may be shaped as a rectangle, or may be of a different shape that is more comfortable to the user, or more accurately fits a body part that the user wants to use the external patch 7 on.

Other undescribed parts in this third embodiment are the same as in the first embodiment.

The Fourth Embodiment

Figure 7:
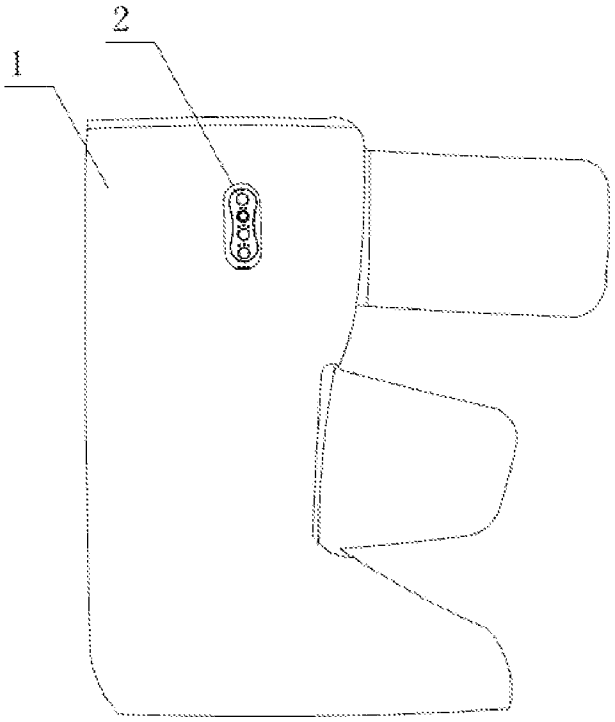
FIG. 7 is a schematic diagram of the fourth embodiment of the present invention.

In addition to the calf, this invention can be also used to cover other body treatment areas, including the foot, leg, arm, buttock, waist, or other body areas. In this fourth embodiment (FIG. 7), the wrap 1 is for the body area of the foot and calf.

Other undescribed parts in this fourth embodiment are the same as in the first embodiment.

The Fifth Embodiment

Figure 8:
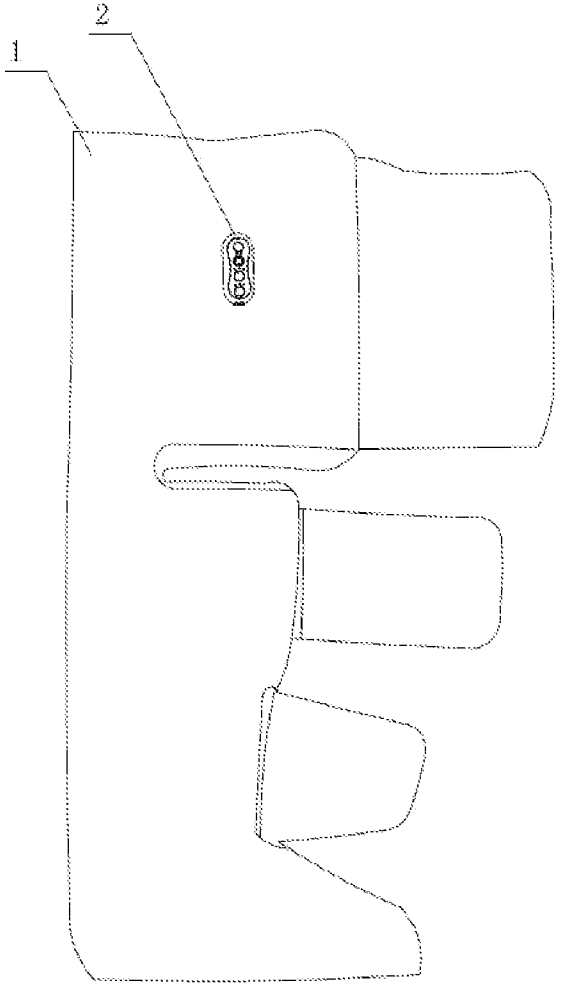
FIG. 8 is a schematic diagram of the fifth embodiment of the present invention.

In addition to the calf, this invention can be also used to cover other body treatment areas, including the foot, leg, arm, buttock, waist, or other body areas. In this fifth embodiment (FIG. 8), the wrap 1 is for the body area of the foot, calf, and thigh.

Other undescribed parts in this fifth embodiment are the same as in the first embodiment.

The Sixth Embodiment

Figure 9:
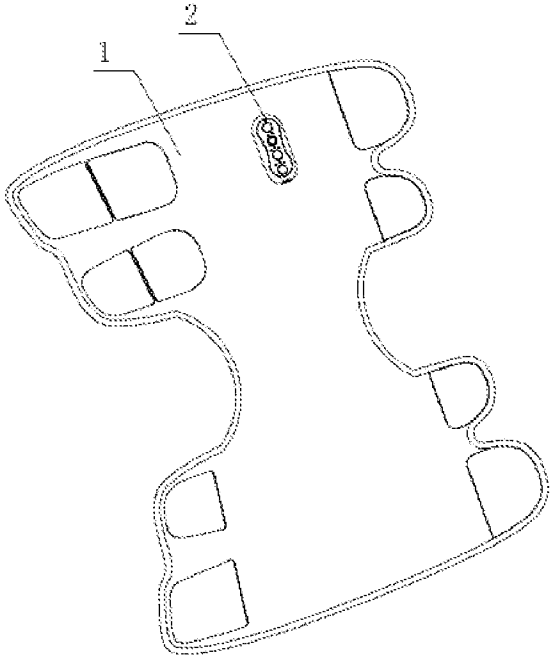
FIG. 9 is a schematic diagram of the sixth embodiment of the present invention.

In addition to the calf, this invention can be also used to cover other body treatment areas, including the foot, leg, arm, buttock, waist, or other body areas. In this sixth embodiment (FIG. 9), the wrap 1 is for the body area of the arm.

Other undescribed parts in this sixth embodiment are the same as in the first embodiment.

The Seventh Embodiment

A pneumatic physiotherapy apparatus with a unique structure comprising a wrap and an operating unit: wherein a wrap includes at least an outer wrap, an inner component housing, and an inner air bladder set; wherein the operating unit is fixed to the outer wrap; wherein the operating unit is also connected to the inner component housing; and wherein the inner component housing is hidden inside the wrap.

The Eighth Embodiment

The apparatus of the seventh embodiment, further comprising: wherein the operating unit is to operate an inflation motor and an integrated control board inside the inner component housing; wherein the inner air bladder set includes a plurality of air bladders, and each air bladder is inflatable; wherein the inflation motor is controlled by the integrated control board; wherein the inflation motor inflates the inner air bladder set; wherein the inner component housing also contains a solenoid valve and a pressure detection valve; wherein the solenoid valve, the pressure detection valve, and the inflation motor are electrically connected to the integrated control board.

The Ninth Embodiment

The apparatus of the seventh embodiment, further comprising: wherein the inflation motor and integrated control board are electrically powered by a battery inside the inner component housing, an AC adapter outside the inner component housing, or a battery bank outside the inner component housing.

The Tenth Embodiment

The apparatus of the seventh embodiment, further comprising: when the inflation pressure inside the inner air bladder set reaches a preset value, the pressure detection valve detects and sends signals to the integrated control board; after receiving those signals, the integrated control board stops the inflation motor; after the inflation motor stops, the inner air bladder set immediately deflates, or maintains the preset pressure for a certain period of time prior to deflation.

The Eleventh Embodiment

The apparatus of the tenth embodiment, further comprising: wherein a pressure protection valve is equipped in the inner component housing; when the pressure inside the inner air bladder set is excessive and beyond an allowable pressure range, the pressure protection valve will be activated, and the excessive pressure will release from the inner air bladder set.

The Twelfth Embodiment

The apparatus of the seventh embodiment, further comprising: wherein the apparatus records and sends out data on how the apparatus is being used; wherein the apparatus sends the data to a computer either through a USB interface, a memory card or Bluetooth; wherein the data can then be analyzed on the computer through artificial intelligence in order to determine optimal patterns for using the apparatus.

The Thirteenth Embodiment

The apparatus of the twelfth embodiment, further comprising: wherein the artificial intelligence can learn the rhythm in which a user enjoys using the apparatus; wherein the artificial intelligence can learn a series of buttons that the user likes being pushed on the apparatus; wherein the artificial intelligence can learn an optimal amount of time that a user wants the apparatus on particular body parts; wherein the artificial intelligence utilizes machine learning, deep learning, or neural networks.

The Fourteenth Embodiment

The apparatus of the seventh embodiment, further comprising: wherein the operating unit is to operate an inflation motor and an integrated control board inside the inner component housing; wherein the inner air bladder set includes a plurality of air bladders, and each air bladder is inflatable; wherein the inflation motor is controlled by the integrated control board; wherein the inflation motor inflates the inner air bladder set; wherein the inner component housing also contains a solenoid valve and a pressure detection valve; wherein the solenoid valve, the pressure detection valve, and the inflation motor are electrically connected to the integrated control board; wherein the inflation motor and integrated control board are electrically powered by a battery inside the inner component housing, an AC adapter outside the inner component housing, or a battery bank outside the inner component housing; when the inflation pressure inside the inner air bladder set reaches a preset value, the pressure detection valve detects and sends signals to the integrated control board; after receiving those signals, the integrated control board stops the inflation motor; after the inflation motor stops, the inner air bladder set immediately deflates, or maintains the preset pressure for a certain period of time prior to deflation; wherein a pressure protection valve is equipped in the inner component housing; when the pressure inside the inner air bladder set is excessive and beyond an allowable pressure range, the pressure protection valve will be activated, and the excessive pressure will release from the inner air bladder set.

The Fifteenth Embodiment

The apparatus of the seventh embodiment, further comprising: wherein the operating unit is to operate an inflation motor and an integrated control board inside the inner component housing; wherein the inner air bladder set includes a plurality of air bladders, and each air bladder is inflatable; wherein the inflation motor is controlled by the integrated control board; wherein the inflation motor inflates the inner air bladder set; wherein the inner component housing also contains a solenoid valve and a pressure detection valve; wherein the solenoid valve, the pressure detection valve, and the inflation motor are electrically connected to the integrated control board; wherein the inflation motor and integrated control board are electrically powered by a battery inside the inner component housing, an AC adapter outside the inner component housing, or a battery bank outside the inner component housing; when the inflation pressure inside the inner air bladder set reaches a preset value, the pressure detection valve detects and sends signals to the integrated control board; after receiving those signals, the integrated control board stops the inflation motor; after the inflation motor stops, the inner air bladder set immediately deflates, or maintains the preset pressure for a certain period of time prior to deflation; wherein a pressure protection valve is equipped in the inner component housing; when the pressure inside the inner air bladder set is excessive and beyond an allowable pressure range, the pressure protection valve will be activated, and the excessive pressure will release from the inner air bladder set; wherein the apparatus records and sends out data on how the apparatus is being used; wherein the apparatus sends the data to a computer either through a USB interface, a memory card or Bluetooth; wherein the data can then be analyzed on the computer through artificial intelligence in order to determine optimal patterns for using the apparatus; wherein the artificial intelligence can learn the rhythm in which a user enjoys using the apparatus; wherein the artificial intelligence can learn a series of buttons that the user likes being pushed on the apparatus; wherein the artificial intelligence can learn an optimal amount of time that a user wants the apparatus on particular body parts; wherein the artificial intelligence utilizes machine learning, deep learning, or neural networks.

The Sixteenth Embodiment

A pneumatic physiotherapy apparatus with a unique structure comprising a wrap and an operating unit: wherein a wrap includes at least an outer wrap, an inner component housing, and an inner air bladder set; wherein the operating unit is fixed to the outer wrap; wherein the operating unit is also connected to the inner component housing; wherein the inner component housing is hidden inside the wrap; wherein the operating unit is to operate an inflation motor and an integrated control board inside the inner component housing; wherein the inner air bladder set includes a plurality of air bladders, and each air bladder is inflatable; wherein the inflation motor is controlled by the integrated control board; wherein the inflation motor inflates the inner air bladder set; wherein the inner component housing also contains a solenoid valve and a pressure detection valve; wherein the solenoid valve, the pressure detection valve, and the inflation motor are electrically connected to the integrated control board; wherein the inflation motor and integrated control board are electrically powered by a battery inside the inner component housing, an AC adapter outside the inner component housing, or a battery bank outside the inner component housing; when the inflation pressure inside the inner air bladder set reaches a preset value, the pressure detection valve detects and sends signals to the integrated control board; after receiving those signals, the integrated control board stops the inflation motor; after the inflation motor stops, the inner air bladder set immediately deflates, or maintain a preset pressure for a certain period of time prior to deflation.

The Seventeenth Embodiment

The apparatus of the sixteenth embodiment, further comprising: wherein the apparatus records and sends out data on how the apparatus is being used; wherein the apparatus sends the data to a computer either through a USB interface, a memory card or Bluetooth; wherein the data can then be analyzed on the computer through artificial intelligence in order to determine optimal patterns for using the apparatus.

The Eighteenth Embodiment

The apparatus of the seventeenth embodiment, further comprising: wherein the artificial intelligence can learn the rhythm in which a user enjoys using the apparatus; wherein the artificial intelligence can learn a series of buttons that the user likes being pushed on the apparatus; wherein the artificial intelligence can learn an optimal amount of time that a user wants the apparatus on particular body parts; wherein the artificial intelligence utilizes machine learning, deep learning, or neural networks.

The Nineteenth Embodiment

A pneumatic physiotherapy apparatus with a unique structure comprising a wrap and an operating unit: wherein a wrap includes at least an outer wrap, an inner component housing, and an inner air bladder set; wherein the operating unit is fixed to the outer wrap; wherein the operating unit is also connected to the inner component housing; wherein the inner component housing is hidden inside the wrap; wherein the operating unit is to operate an inflation motor and an integrated control board inside the inner component housing; wherein the inner air bladder set includes a plurality of air bladders, and each air bladder is inflatable; wherein the inflation motor is controlled by the integrated control board: wherein the inflation motor inflates the inner air bladder set; wherein the inner component housing also contains a solenoid valve and a pressure detection valve; wherein the solenoid valve, the pressure detection valve, and the inflation motor are electrically connected to the integrated control board; wherein the inflation motor and integrated control board are electrically powered by a battery inside the inner component housing, an AC adapter outside the inner component housing, or a battery bank outside the inner component housing; wherein the apparatus records and sends out data on how the apparatus is being used; wherein the apparatus sends the data to a computer either through a USB interface, a memory card or Bluetooth; wherein the data can then be analyzed on the computer through artificial intelligence in order to determine optimal patterns for using the apparatus.

The Twentieth Embodiment

The apparatus of the nineteenth embodiment, further comprising: when the inflation pressure inside the inner air bladder set reaches a preset value, the pressure detection valve detects and sends signals to the integrated control board; after receiving those signals, the integrated control board stops the inflation motor; after the inflation motor stops, the inner air bladder set immediately deflates, or maintain a preset pressure for a certain period of time prior to deflation.

The Twenty-First Embodiment

The apparatus of the nineteenth embodiment, further comprising: wherein a pressure protection valve is equipped in the inner component housing; when the pressure inside the inner air bladder set is excessive and beyond an allowable pressure range, the pressure protection valve will be activated, and the excessive pressure will release from the inner air bladder set.

The Twenty-Second Embodiment

The apparatus of the nineteenth embodiment, further comprising: wherein the artificial intelligence can learn the rhythm in which a user enjoys using the apparatus; wherein the artificial intelligence can learn a series of buttons that the user likes being pushed on the apparatus; wherein the artificial intelligence can learn an optimal amount of time that a user wants the apparatus on particular body parts; wherein the artificial intelligence utilizes machine learning, deep learning, or neural networks.

The Twenty-Second Embodiment

The apparatus of the nineteenth embodiment, further comprising: when the inflation pressure inside the inner air bladder set reaches a preset value, the pressure detection valve detects and sends signals to the integrated control board; after receiving those signals, the integrated control board stops the inflation motor; after the inflation motor stops, the inner air bladder set immediately deflates, or maintain a preset pressure for a certain period of time prior to deflation; wherein a pressure protection valve is equipped in the inner component housing; when the pressure inside the inner air bladder set is excessive and beyond an allowable pressure range, the pressure protection valve will be activated, and the excessive pressure will release from the inner air bladder set.

The Twenty-Third Embodiment

The apparatus of the nineteenth embodiment, further comprising: when the inflation pressure inside the inner air bladder set reaches a preset value, the pressure detection valve detects and sends signals to the integrated control board; after receiving those signals, the integrated control board stops the inflation motor; after the inflation motor stops, the inner air bladder set immediately deflates, or maintain a preset pressure for a certain period of time prior to deflation; wherein a pressure protection valve is equipped in the inner component housing; when the pressure inside the inner air bladder set is excessive and beyond an allowable pressure range, the pressure protection valve will be activated, and the excessive pressure will release from the inner air bladder set; wherein the artificial intelligence can learn the rhythm in which a user enjoys using the apparatus; wherein the artificial intelligence can learn a series of buttons that the user likes being pushed on the apparatus; wherein the artificial intelligence can learn an optimal amount of time that a user wants the apparatus on particular body parts; wherein the artificial intelligence utilizes machine learning, deep learning, or neural networks.

The above are the preferred solutions of the invention, showing and describing the basic principles, main features and advantages of the invention. Those skilled in the art should understand that the present invention is not limited by the above-mentioned embodiments. The above-mentioned embodiments and description only illustrate the principle of the present invention. There will be various changes and improvements; these changes and improvements fall within the scope of the claimed invention, which is defined by the appended claims and their equivalents.

The invention claimed is:

1. A pneumatic physiotherapy apparatus with a structure comprising a wrap and an operating unit:

wherein the wrap includes at least an outer wrap, an inner component housing, and an inner air bladder set;

wherein the operating unit is fixed to the outer wrap;

wherein the operating unit is also connected to the inner component housing;

wherein the inner component housing is hidden inside the outer wrap;

wherein the operating unit is outside the wrap;

wherein the inner air bladder set is adjacent to the inner component housing;

wherein the outer wrap is between the operating unit and the inner component housing;

wherein the wrap includes an optional patch outside to provide hot/warm and/or cold/cool wherein the operating unit is to operate an inflation motor inside the inner component housing; and wherein the inner component housing contains a valve.

2. The apparatus of claim 1, further comprising:

wherein the operating unit is to further operate an integrated control board inside the inner component housing;

wherein the inner air bladder set includes one or more air bladders, and each air bladder is inflatable;

wherein the inflation motor is controlled by the integrated control board;

wherein the inflation motor inflates the inner air bladder set;

wherein the valve inside the inner component housing is either a solenoid valve or a pressure valve;

wherein the solenoid valve, the pressure detection valve, and the inflation motor are electrically connected to the integrated control board.

3. The apparatus of claim 1, further comprising:

wherein the inflation motor and integrated control board are electrically powered by a battery inside the inner component housing, an AC adapter outside the inner component housing, or a battery bank outside the inner component housing.

4. The apparatus of claim 1, further comprising:

when the inflation pressure inside the inner air bladder set reaches a preset value, the pressure detection valve detects and sends signals to the integrated control board;

after receiving those signals, the integrated control board stops the inflation motor;

after the inflation motor stops, the inner air bladder set immediately deflates, or maintains the preset pressure for a certain period of time prior to deflation.

5. The apparatus of claim 4, further comprising:

wherein a pressure protection valve is equipped in the inner component housing;

when the pressure inside the inner air bladder set is excessive and beyond an allowable pressure range, the pressure protection valve will be activated, and the excessive pressure will release from the inner air bladder set.

6. The apparatus of claim 5, further comprising:

wherein the apparatus records and sends out data on how the apparatus is being used;

wherein the apparatus sends the data to a computer either through a USB interface, a memory card or Bluetooth;

wherein the data can then be analyzed on the computer through artificial intelligence in order to determine optimal patterns for using the apparatus.

7. The apparatus of claim 6, further comprising:

wherein the artificial intelligence can learn a rhythm in which a user enjoys using the apparatus;

wherein the artificial intelligence can learn a series of buttons that the user likes being pushed on the apparatus;

wherein the artificial intelligence can learn an optimal amount of time that a user wants the apparatus on particular body parts;

wherein the artificial intelligence utilizes machine learning, deep learning, or neural networks.

8. The apparatus of claim 1, further comprising:

wherein the operating unit is to operate an inflation motor and an integrated control board inside the inner component housing;

wherein the inner air bladder set includes one or more air bladders, and each air bladder is inflatable;

wherein the inflation motor is controlled by the integrated control board;

wherein the inflation motor inflates the inner air bladder set;

wherein the inner component housing also contains a solenoid valve and a pressure detection valve;

wherein the solenoid valve, the pressure detection valve, and the inflation motor are electrically connected to the integrated control board;

wherein the inflation motor and integrated control board are electrically powered by a battery inside the inner component housing, an AC adapter outside the inner component housing, or a battery bank outside the inner component housing;

when the inflation pressure inside the inner air bladder set reaches a preset value, the pressure detection valve detects and sends signals to the integrated control board;

after receiving those signals, the integrated control board stops the inflation motor;

after the inflation motor stops, the inner air bladder set immediately deflates, or maintains the preset pressure for a certain period of time prior to deflation;

wherein a pressure protection valve is equipped in the inner component housing;

when the pressure inside the inner air bladder set is excessive and beyond an allowable pressure range, the pressure protection valve will be activated, and the excessive pressure will release from the inner air bladder set.

9. The apparatus of claim 1, further comprising:

wherein the operating unit is to operate an inflation motor and an integrated control board inside the inner component housing;

wherein the inner air bladder set includes one or more air bladders, and each air bladder is inflatable;

wherein the inflation motor is controlled by the integrated control board;

wherein the inflation motor inflates the inner air bladder set;

wherein the inner component housing also contains a solenoid valve and a pressure detection valve;

wherein the solenoid valve, the pressure detection valve, and the inflation motor are electrically connected to the integrated control board;

wherein the inflation motor and integrated control board are electrically powered by a battery inside the inner component housing, an AC adapter outside the inner component housing, or a battery bank outside the inner component housing;

when the inflation pressure inside the inner air bladder set reaches a preset value, the pressure detection valve detects and sends signals to the integrated control board;

after receiving those signals, the integrated control board stops the inflation motor;

after the inflation motor stops, the inner air bladder set immediately deflates, or maintains the preset pressure for a certain period of time prior to deflation;

wherein a pressure protection valve is equipped in the inner component housing;

when the pressure inside the inner air bladder set is excessive and beyond an allowable pressure range, the pressure protection valve will be activated, and the excessive pressure will release from the inner air bladder set;

wherein the apparatus records and sends out data on how the apparatus is being used;

wherein the apparatus sends the data to a computer either through a USB interface, a memory card or Bluetooth;

wherein the data can then be analyzed on the computer through artificial intelligence in order to determine optimal patterns for using the apparatus;

wherein the artificial intelligence can learn the rhythm in which a user enjoys using the apparatus;

wherein the artificial intelligence can learn a series of buttons that the user likes being pushed on the apparatus;

wherein the artificial intelligence can learn an optimal amount of time that a user wants the apparatus on particular body parts;

wherein the artificial intelligence utilizes machine learning, deep learning, or neural networks.

10. The apparatus of claim 1, further comprising:

wherein an external patch is attached to and detached from the wrap, and the external patch is used to provide the hot/warm and/or cold/cool treatment;

wherein the external patch may be shaped as a rectangle, or may be of a different shape that is more comfortable to the user, or more accurately fits a body part that the user wants to use the external patch on.

11. The apparatus of claim 1, further comprising:

wherein the apparatus can be used to cover a user's calf, foot, leg, arm, buttock, waist, or other body areas.

12. A pneumatic physiotherapy apparatus with a structure comprising a wrap and an operating unit:

wherein a wrap includes at least an outer wrap, an inner component housing, and an inner air bladder set;

wherein the operating unit is fixed to the outer wrap;

wherein the operating unit is also connected to the inner component housing;

wherein the inner component housing is hidden inside the outer wrap;

wherein the operating unit is outside the wrap wherein the operating unit is to operate an inflation motor and an integrated control board inside the inner component housing;

wherein the inner air bladder set includes one or more air bladders, and each air bladder is inflatable;

wherein the inflation motor is controlled by the integrated control board;

wherein the inflation motor inflates the inner air bladder set;

wherein the inner component housing also contains a solenoid valve and a pressure detection valve;

wherein the solenoid valve, the pressure detection valve, and the inflation motor are electrically connected to the integrated control board;

wherein the inflation motor and integrated control board are electrically powered by a battery inside the inner component housing, an AC adapter outside the inner component housing, or a battery bank outside the inner component housing;

when the inflation pressure inside any air bladder reaches a preset value, the pressure detection valve detects and sends signals to the integrated control board;

after receiving those signals, the integrated control board stops the inflation motor;

after the inflation motor stops, the inner air bladder set immediately deflates, or maintain a preset pressure for a certain period of time prior to deflation; and wherein the outer wrap is between the operating unit and the inner component housing.

13. The apparatus of claim 12, further comprising:

wherein the apparatus records and sends out data on how the apparatus is being used;

wherein the apparatus sends the data to a computer either through a USB interface, a memory card or Bluetooth;

wherein the data can then be analyzed on the computer through artificial intelligence in order to determine optimal patterns for using the apparatus.

14. The apparatus of claim 13, further comprising:

wherein the artificial intelligence can learn a rhythm in which a user enjoys using the apparatus;

wherein the artificial intelligence can learn a series of buttons that the user likes being pushed on the apparatus;

wherein the artificial intelligence can learn an optimal amount of time that a user wants the apparatus on particular body parts;

wherein the artificial intelligence utilizes machine learning, deep learning, or neural networks.

15. A pneumatic physiotherapy apparatus with a structure comprising a wrap and an operating unit:

wherein a wrap includes at least an outer wrap, an inner component housing, and an inner air bladder set;

wherein the operating unit is fixed to the outer wrap;

wherein the operating unit is also connected to the inner component housing;

wherein the inner component housing is hidden inside the outer wrap;

wherein the operating unit is outside the wrap wherein the operating unit is to operate an inflation motor and an integrated control board inside the inner component housing;

wherein the inner air bladder set includes one or more air bladders, and each air bladder is inflatable;

wherein the inflation motor is controlled by the integrated control board;

wherein the inflation motor inflates the inner air bladder set;

wherein the inner component housing also contains a solenoid valve and a pressure detection valve;

wherein the solenoid valve, the pressure detection valve, and the inflation motor are electrically connected to the integrated control board;

wherein the inflation motor and integrated control board are electrically powered by a battery inside the inner component housing, an AC adapter outside the inner component housing, or a battery bank outside the inner component housing;

wherein the apparatus records and sends out data on how the apparatus is being used;

wherein the apparatus sends the data to a computer either through a USB interface, a memory card or Bluetooth;

wherein the data can then be analyzed on the computer through artificial intelligence in order to determine optimal patterns for using the apparatus; and wherein the outer wrap is between the operating unit and the inner component housing.

16. The apparatus of claim 15, further comprising:

when the inflation pressure inside any air bladder reaches a preset value, the pressure detection valve detects and sends signals to the integrated control board;

after receiving those signals, the integrated control board stops the inflation motor;

after the inflation motor stops, the inner air bladder set immediately deflates, or maintain a preset pressure for a certain period of time prior to deflation.

17. The apparatus of claim 15, further comprising:

wherein a pressure protection valve is equipped in the inner component housing;

when the pressure inside the inner air bladder set is excessive and beyond an allowable pressure range, the pressure protection valve will be activated, and the excessive pressure will release from the inner air bladder set.

18. The apparatus of claim 15, further comprising:

when the inflation pressure inside any air bladder reaches a preset value, the pressure detection valve detects and sends signals to the integrated control board;

after receiving those signals, the integrated control board stops the inflation motor;

after the inflation motor stops, the inner air bladder set immediately deflates, or maintain a preset pressure for a certain period of time prior to deflation;

wherein a pressure protection valve is equipped in the inner component housing;

when the pressure inside the inner air bladder set is excessive and beyond an allowable pressure range, the pressure protection valve will be activated, and the excessive pressure will release from the inner air bladder set.

19. The apparatus of claim 15, further comprising:

wherein the artificial intelligence can learn a rhythm in which a user enjoys using the apparatus;

wherein the artificial intelligence can learn a series of buttons that the user likes being pushed on the apparatus;

wherein the artificial intelligence can learn an optimal amount of time that a user wants the apparatus on particular body parts;

wherein the artificial intelligence utilizes machine learning, deep learning, or neural networks.

* * * * *